US006142079A

United States Patent [19]

Diorio

[11] Patent Number: 6,142,079

[45] Date of Patent: Nov. 7, 2000

[54] AREA DENIAL MUNITION SYSTEM

[75] Inventor: Frank Diorio, Lake Hopatcong, N.J.

[73] Assignee: The United States of America as represented by the Secretary of the Army, Washington, D.C.

[21] Appl. No.: 09/203,662

[22] Filed: Dec. 3, 1998

[51] Int. Cl.[7] ..... F42C 11/06; F42C 15/184

[52] U.S. Cl. ..... 102/215; 102/226; 102/216; 102/427; 102/266

[58] Field of Search ..... 102/215, 226, 102/266, 216, 218, 427

[56] References Cited

U.S. PATENT DOCUMENTS

| | | | |
|---|---|---|---|
| 3,763,780 | 10/1973 | Kasinoff | 102/19.2 |
| 3,913,483 | 10/1975 | Wolterman | 102/56 |
| 4,455,940 | 6/1984 | Furuike | 102/228 |
| 4,580,498 | 4/1986 | Abt et al. | 102/215 |
| 4,694,752 | 9/1987 | Titus | 102/215 |
| 4,852,496 | 8/1989 | Campagnuolo et al. | 102/322 |
| 5,387,257 | 2/1995 | Tari et al. | 102/226 |

*Primary Examiner*—Michael J. Carone
*Assistant Examiner*—Lulit Semunegus
*Attorney, Agent, or Firm*—John F. Moran; Michael E. Sachs

[57] ABSTRACT

The invention relates to a random time delay fuze for an area denial submunition with anti-disturbance capability.

1 Claim, 3 Drawing Sheets

AREA DENIAL MUNITION SYSTEM

GOVERNMENTAL INTEREST

The invention described herein may be manufactured, used and licensed by or for the United States Government for governmental purposes.

BACKGROUND OF THE INVENTION

The armed services has for a long period of time had the need for an effective munition system that would attack both equipment and personnel if caught in an exposed position and to deny movement from an operational area to a protectively covered location. The ability to restrict observed enemy forces from maneuvering to either new offensive or defensive positions is frequently critical in determining the success or failure of an engagement. Prior art devices such as described in U.S. Pat. No. 5,387,257 were designed to self-destruct in the event the munition malfunctioned after striking an intended target but did not restrict the movement or counter attack capabilities of surviving forces.

SUMMARY OF THE INVENTION

The present invention relates to a random time delay for an area denial munition system that does not function on impact, but will destruct if moved after impact or after a random time period.

An object of the present invention is to "freeze" the enemy for a specified period of time by seeding entrances, roadways, and operational areas with a munition delivered by artillery or missile.

Another object of the present invention is to provide an area denial submunition which can restrict movement and use of operational areas to enemy forces while inflicting damage to equipment and personnel.

Another object of the present invention is to provide a submunition which can function at random times rather than at a pre-set fixed time.

A further object of the present invention is to allow arming of the fuze but prevent functioning on ground or target impact and to permit later functioning at random times, or upon disturbance recognized by a motion sensor incorporated in a electronic logic circuit.

For a better understanding of the present invention, together with other and further objects thereof, reference is made to the following descriptions taken in connection with the accompanying drawings.

BRIEF DESCRIPTION OF THE DRAWINGS

Throughout the following description like numerals are used to designate like parts of the drawings.

DESCRIPTION OF THE PREFERRED EMBODIMENTS

Figure 1:
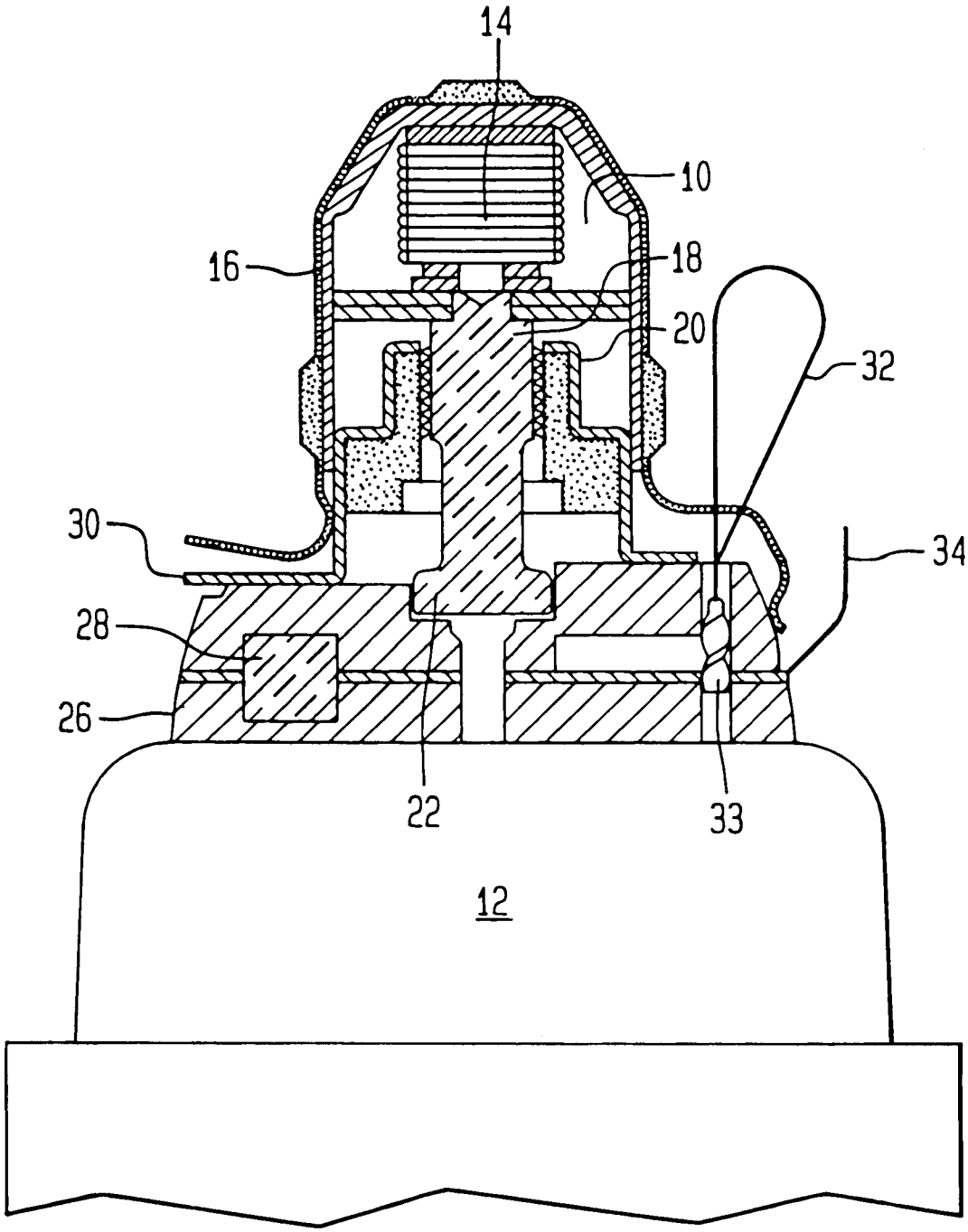
FIG. 1 is a diametral cross-sectional view of an area denial munition.

Referring now to FIG. 1, the random time delay fuze 10 is mounted on top of a submunition 12. This new combination has been designed to allow arming of the fuze in a similar fashion to the self-destruct fuze described in U.S. Pat. No. 5,387,257, but has been modified to prevent functioning on ground or target impact. This new device permits later functioning at random times or upon a disturbance sensed by a motion sensor. As in the aforementioned patent the arming mode includes a ribbon stabilizer 14 covered by a packable aerodynamically removable slide lock cover 16. The ribbon stabilizer 14 is mechanically connected to an arming screw 18 which is threadedly supported by threaded inertial weight 20. The bottom end 22 of arming screw 18 is flat and engages a spring loaded electrical slide assembly 26 which contains an M55 stab detonator 28 which does not interact with the arming screw 18 because its firing pin has been removed. The components of the electrical and mechanical modes are contained within the same fuze housing member 30. An aerodynamic ribbon spiral member 32 is attached to spiral safety member 33 which acts as an unlocking safety for the electrical random time delay destruct mode. An aerodynamic unlocking electrical safety member 34 acts as an electro-explosive shunt.

Figure 2:
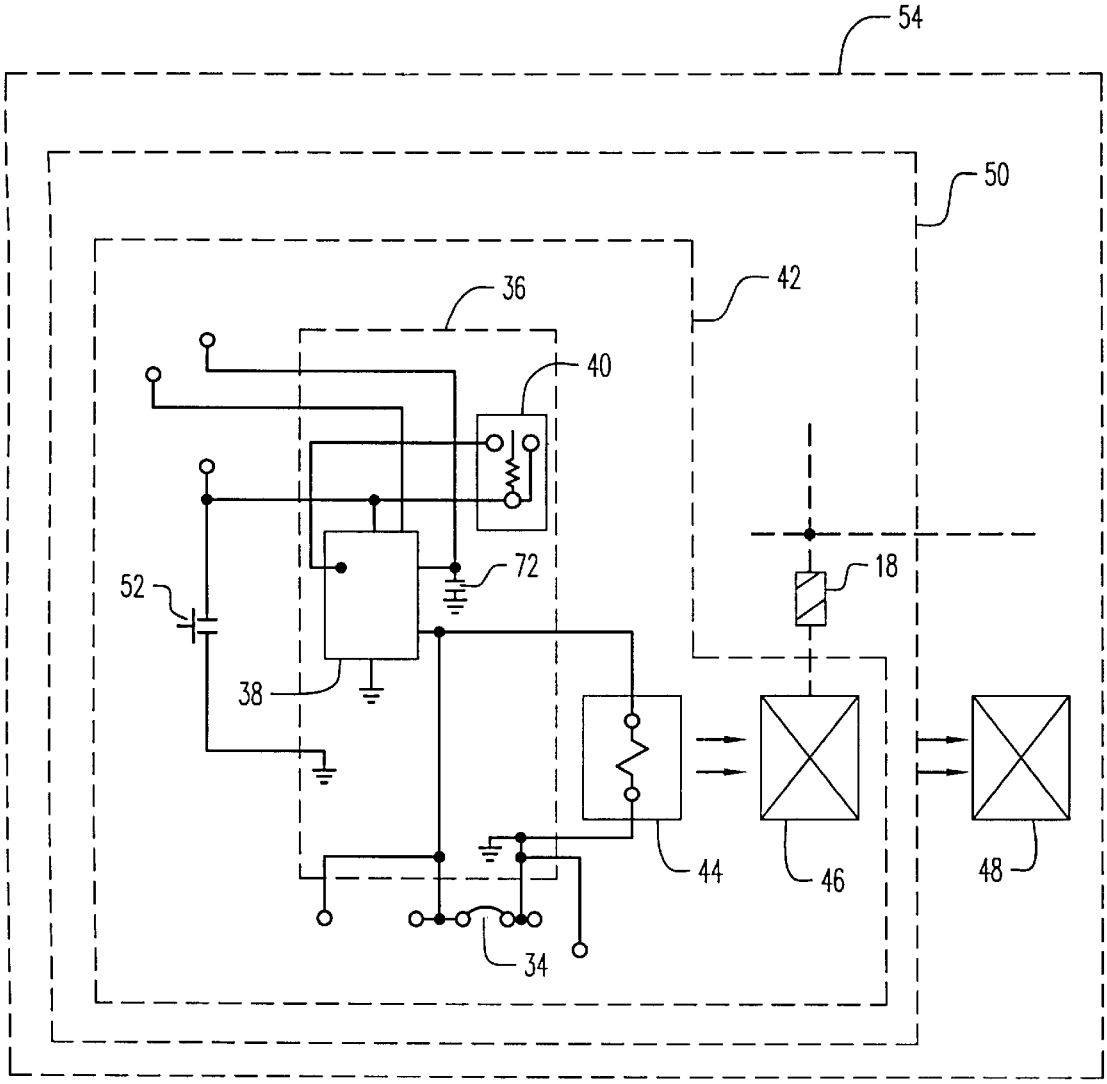
FIG. 2 is an electrical schematic of the random time delay fuze.

Referring now to FIGS. 1 and 2, the electrical slide subassembly 26 is included within dash line 36 and comprises an integrated circuit chip 38 for signal input and associated processing logic and an anti-disturbance switch 40 operatively connected thereto. The slide subassembly 26 also includes within dash lines 42 the circuit for aerodynamic shunt safety 34, an electro-explosive device 44 and a M55 stab detonator 46. The dashed lines 50 includes the arming screw 18 which releases the slide assembly 26 and activates a reserve battery 52. A lead charge 48 is located within dash lines 54 and is initiated by stab detonator 46.

Figure 3:
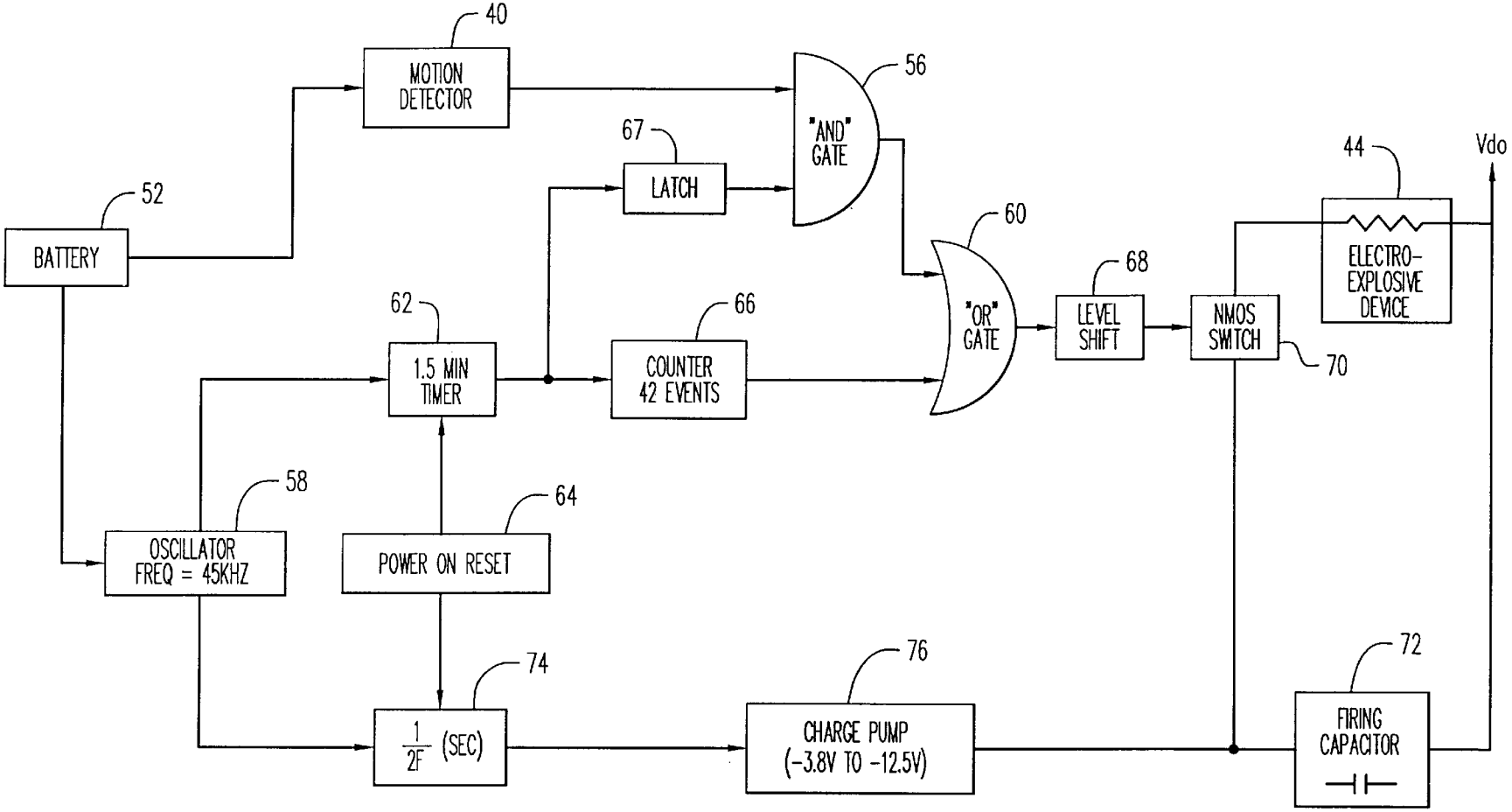
FIG. 3 is a block diagram of the random time delay fuze function of the area denial munition shown in FIGS. 1 and 2.

In operation the grenade submunition 12 is released from its carrier over the target area. The wind stream removes the packable slide lock 16 which causes the ribbon stabilizer drag device 14 to be deployed. At approximately the same time, wind forces on spiral ribbon 32 removes the spiral safety member 33 and the electro-explosive safety shunt 34. The reserve battery 52 is activated when the arming screw 18 is withdrawn from the spring loaded slide assembly 26 by ribbon stabilizer 14. Power is supplied to the integrated chip 38 and to the motion sensor 40. Arming screw 18 release of the spring loaded slide assembly 26 mechanically moves the stab detonator 46 so that the electro-explosive device 46 and the lead charge 48 are in alignment. The submunition 12 is now ready to fire the electro-explosive device 44 dependent upon whether a fire signal is initiated by the motion sensor switch 40 or the random time delay integrated circuit 38. Referring now to FIG. 3, the random time delay integrated circuit 38 includes an "And" logic gate 56. The logic element requires a signal from both the motion sensor 40 and a 45 kilohertz voltage signal from the oscillator 58 to provide a valid output signal to a first input terminal of an "Or" logic gate 60. A 1.5 Min. timer 62 has input terminals electrically coupled to the output oscillator 58 and to a Power-On-Reset 64. The delay time circuitry provides a safe time period during which a motion stimulus, from the motion detector 40, would not cause a fire signal and subsequent detonation. This is to preclude undesirable and unwanted detonation as a result of motion or disturbance during air or ground deployment. The Power-On-Reset circuitry initializes the tuning function to start at time "zero" when the battery 52 is activated and the voltage reaches a specified level. The output of the 1.5 Min. timer 62 is coupled to a second input terminal of the "and" gate 56 through a latch element 67. The output of the 1.5 Min. Timer 62 is also coupled to a second input terminal of the "Or"

logic gate 60 through a counter (42 events) 66. The counter 66 provides various multiple (42) time-outs in increments of 1.5 minutes. This provides the method for "random" periods at which a fire signal can be generated. The output of the "or" gate 60 is connected to a level shift circuit 68. A valid signal output from the "Or" gate sensed by the level shift circuit 68 causes a voltage level change. This "shift" in voltage level turns on the NMOS switch 70 which will close the parallel circuit allowing the firing capacitor 72 to discharge its energy to the electro-explosive element 44. The NMOS switch 70 is an electronic semi-conductor which will change to a conduct mode by the change in voltage level provided by the level shift circuit 68. The firing capacitor 72 discharge circuit is activated approximately 2 minutes after any fire command through a ½f (sec) delay 74 and voltage multiplier charge pump 76. The firing capacitor 72 once discharged cannot be recharged because the oscillator 52 has been stopped. This is accomplished approximately 2 minutes after a fire command when the oscillator 58 is stopped by the electrical clamp or latch 67. Stopping the oscillator 58 "freezes" any circuit activity that could cause a subsequent fire command. This oscillator stop function is used to improve safety for handling and for Engineering Ordnance Disposal.

Random time delay to fire is accomplished by tapping off timer outputs on the integrated chip 38 at multiples of 1.5 minutes up to one hour and randomly mixing these at the time of fabrication of the fuzes. Another approach to random time delay can be used by manufacturing timer chips in increments of 6 minutes up to 240 minutes to obtain a longer delaying time as an affective area denial method.

While specific embodiments of the invention have been shown and described in detail to illustrate the application of the principles of the invention, it will be understood that the invention may be embodied otherwise without departing from such principles.

What is claimed is:

1. A random time delay fuze for an area denial submunition system which comprises:

fuze housing means, operatively connected to such submunition, for protecting said time delay fuze during deployment, wherein said fuze housing means includes a fuze housing for operatively holding said arming means and said integrated circuit chip means attached to said submunition; and a slide lock cover aerodynamically removeably connected to said fuze housing;

aerodynamic removable safety means for preventing the arming of said submunition prior to deployment of said submunition, said aerodynamic removeable safety means including: a spring loaded slide assembly for holding said means for arming and said integrated circuit chip means, wherein said spring loaded slide assembly includes an electro-explosive member electrically coupled to said integrated circuit chip means, and a stab detonator which is placed in juxtaposition with said electro-explosive detonator when said random time delay fuze is armed and at the intended target location; an arming screw for releasably holding said slide assembly in a safe position prior to deployment of said submunition and for allowing movement of said slide assembly when said arming screw is aerodynamically withdrawn during deployment of said submunition over target; aerodynamic spiral safety means for preventing movement of said slide assembly prior to submunition deployment and for releasing said slide assembly when said submunition is released over said target; and aerodynamic shunt safety means for preventing the electrical operation of said integrated circuit chip means prior to deployment of said submunition on said target;

means for arming said submunition while said submunition is deploying over target area, and for preventing firing of said submunition during inertial impact on a target; and integrated circuit chip means for providing random time delay for firing said submunition after deployment and for firing said submunition upon disturbance after deployment, said integrated circuit chip means including: reserve battery means for supplying power to said integrated circuit chip means after said area denial submunition has been deployed on said target area; firing capacitor means electrically coupled to said battery means for actuating said electro-explosive detonator; motion detector means electrically connected to said battery means and said chip means for triggering an output signal from said chip means when said submunition is disturbed after being deployed on said target area; and logic means electrically coupled to said motion detector means and said battery means for processing a fire signal from said motion detector and for generating a random time delay output fire signal for said electro-explosive detonator, wherein said logic means includes:

oscillator means coupled to said battery means for generating a 45 kilohertz output signal;

"and" logic gate means for requiring both a signal from said motion sensor means and said oscillator means to provide a valid output signal;

counter means operatively connected to said oscillator means output signal for providing various multiple time-outs in increments of 1.5 minutes thereby providing random periods at which a fire signal can be generated;

"or" logic gate means coupled to the output of said "and" gate means and said counter means for allowing a fire pulse upon a signal from either said motion sensor means or at a random time from said counter at one of the multiple time-out events;

delay time circuitry means coupled intermediate said oscillator means output signal and an input terminal of said "and" gate means and an input terminal of said counter means, for providing a safe time period during which a motion stimulus from said motion detector means would not cause a fire signal or a detonation of said electro-explosive detonator as a result of motion or disturbance during air or ground deployment of said submunition;

latch means electrically connected intermediate said delay time circuit means and an input terminal of said "and" gate means, for stopping said oscillator means from recharging said firing capacitor means after once discharged, thereby improving handling safety during ordnance disposal;

NMOS switch means operatively connected intermediate an output terminal of said "or" gate means and said firing capacitor and said electro-explosive detonator means for changing to a conduct mode and allowing said firing capacitor means to discharge its energy;

level shift means electrically coupled intermediate said "or" gate means and said NMOS switch means for sensing a valid signal output of said "or" gate means and causing a shift in voltage level which turns on said NMOS switch means which in turn closes a parallel circuit allowing said firing capacitor means to discharge its energy to said electro-explosive detonator member;

charge pump voltage multiplier means electrically coupled intermediate said oscillator means and said firing capacitor means for multiplying the output voltage from said oscillator means; and power on reset circuit means for initializing the timing function of said delay time circuit means to start at time "zero" when said battery means is activated and its output voltage reaches a specified level.

* * * * *